US005833540A

United States Patent [19]

Miodunski et al.

[11] Patent Number: 5,833,540

[45] Date of Patent: Nov. 10, 1998

[54] CARDLESS DISTRIBUTED VIDEO GAMING SYSTEM

[75] Inventors: Robert L. Miodunski, Henderson; Richard J. Schneider; Robert J. Craig, both of Las Vegas, all of Nev.

[73] Assignee: United Games, Inc., Las Vegas, Nev.

[21] Appl. No.: 719,253

[22] Filed: Sep. 24, 1996

[51] Int. Cl.[6] ..... A63F 9/00

[52] U.S. Cl. ..... 463/42

[58] Field of Search ..... 463/29, 30, 25, 463/40, 41, 42, 43, 47

[56] References Cited

U.S. PATENT DOCUMENTS

| | | |
|---|---|---|
| 4,636,951 | 1/1987 | Harlick . |
| 4,882,473 | 11/1989 | Bergeron et al. . |
| 5,083,271 | 1/1992 | Thacher et al. . |
| 5,159,549 | 10/1992 | Hallman, Jr. et al. . |
| 5,265,874 | 11/1993 | Dickinson et al. . |
| 5,276,312 | 1/1994 | McCarthy . |
| 5,324,035 | 6/1994 | Morris et al. . |
| 5,326,104 | 7/1994 | Pease et al. . |
| 5,332,076 | 7/1994 | Ziegert . |
| 5,344,144 | 9/1994 | Canon . |
| 5,354,069 | 10/1994 | Guttman et al. . |
| 5,398,932 | 3/1995 | Eberhardt et al. . |
| 5,702,304 | 12/1997 | Acres et al. ..... 463/47 |

*Primary Examiner*—George Manuel
*Attorney, Agent, or Firm*—Knobbe, Martens, Olson & Bear, LLP

[57] ABSTRACT

A distributed players' club network comprised of a plurality of games positioned in a plurality of locations that are interconnected by a wide area network to a central computer which has files for each player who has enrolled to play in a bonus club system. The gaming machines have communication devices which send information to the central computer indicative of a player playing at the game and also receive information from the central computer. The communication devices are configured to allow the player to enroll directly at the game by selecting a member ID number and a personal identification number which are then transmitted to the central computer causing the central computer to open a file for the particular player. Further, the gaming machine provides information to a processor within the communication device while the player is playing the game and the processor, in conjunction with the central computer, determines whether the player is entitled to receive a bonus award based upon his or her play. In the event that the player is entitled to a bonus award, this award can be distributed to the player by adding credits to the gaming machine.

38 Claims, 5 Drawing Sheets

CARDLESS DISTRIBUTED VIDEO GAMING SYSTEM

BACKGROUND OF THE INVENTION

1. Field of the Invention

The present invention generally relates to a gambling or gaming system and, more particularly, concerns a gaming system wherein a plurality of gaming devices are located at distributed locations and are linked together into a wide area network.

2. Description of the Related Art

All forms of gaming and gambling are experiencing increased popularity. In particular, gaming devices such as slot machines and video poker games have become very popular with the gaming public. The popularity of these types of machines has led to several developments whereby gaming machine owners are attempting to encourage players to enter their establishments and play their games.

For example, players' clubs are one method of encouraging players to gamble in particular establishments. A players' club system is comprised of a series of networked games and a central computer. Each of the networked games includes a card reader and each of the players in the players' club is given a card. The player inserts the card into the card reader when the player is initiating a session of play on the gaming machine. The card reader then identifies the player to a central computer and the performance of the player is recorded. In the typical players' club, the player is awarded bonus points for rounds played or for winnings received. The player then receives awards for winning individual rounds of the game and also receives additional bonus awards for playing in the players' club. Hence, players' clubs are popular with players as a result of the players receiving increased awards or bonuses while playing as part of the players' club. Players' clubs thereby encourage players who have signed up with a particular club to play in establishments having games that are in a players' club network.

While players' clubs are popular, they are generally limited to very large gaming establishments. There is a significant expense in networking games together, equipping them with card readers and establishing the support structures necessary for the players' club. For example, each players' club generally requires an attendant who will sign up new players into the club. The attendant is typically positioned within a booth that is positioned adjacent the gaming devices that are in the players' club network. Further, the typical players' club also requires the player who has received a bonus award, e.g., enough bonus points, to go to a redemption booth to receive their bonus award. Hence, it can be appreciated that a players' club system requires a large number of machines capable of accommodating a large volume of players to justify the expense of the enrollment and redemption booth and attendant. Consequently, players' clubs have traditionally been limited to generally larger gaming establishments.

In addition, if a smaller gaming establishment cannot support an on-site enrollment and redemption attendant they must either forgo installing a players' club or their players' club must be part of a network which supports the enrollment and redemption staff. Hence, in these systems the players are obligated to go to another location to enroll or redeem awards. However, many players are less inclined to go offsite to enroll or seek bonus awards. Hence, the desirability of installing distributed players' club-type gaming systems in small gaming establishments, like bars and small casinos, is limited.

A further difficulty with typical players' club systems is that they use magnetic cards as a means of identifying the players when they are playing on one of the networked machines. However, players often lose these cards and thereby forfeit any accumulated bonus points. It is, of course, difficult for the player to replace this card prior to a subsequent play session unless there is a place to obtain an additional card. This underscores the difficulty with establishing players' club systems in smaller venues that cannot afford to have a person on site to distribute cards within that establishment.

Hence, there is a need for a players' club system that can be implemented in smaller business establishments having gaming machines. To this end, there is a need for a players' club system that can be distributed through a number of different business establishments having gaming machines. This system should also allow for enrollment at each of the locations where the gaming machines are located and also allow for redemption of bonus points and the like in each of the locations containing the gaming machines.

SUMMARY OF THE INVENTION

The aforementioned needs are satisfied by the gaming system of the present invention which is comprised of a network of games distributed through multiple locations and all linked via a network to a central computer. When a player plays a particular game, the game transmits information about the player's play to the central computer which maintains a record of the player's performance. The gaming system is configured so that when the player receives bonus awards, the bonus awards are downloaded to the game in the form of credits. Hence, with the system of the present invention, it is not necessary for the player to go to a redemption location to redeem bonus awards from the system.

In another aspect of the present invention, the network allows for players to enroll in the players' club directly at the machine. Specifically, in the preferred embodiment each of the games of the network includes a keypad from which the player can input information which is then sent to the central computer. The player can enroll in the players' club at the game by inputting a preselected enrollment identification number. The player in the preferred embodiment is then prompted to provide an account identification number and a personal identification number. Preferably, the player selects both of these numbers and these numbers are then transmitted to the central computer so that the central computer can develop an account for this particular player. After the player has enrolled by selecting the account identification number and the personal identification number, the player is then free to play the game and accumulate bonus awards in the players' club.

During subsequent play sessions, the player simply has to enter the selected account number and the selected personal identification number at the game and this information is then transmitted to the central computer. Since the player has selected his or her own account number and personal information number, it is less likely that the player will forget these numbers and be unable to initiate a play session on the system. Hence, the problems associated with players losing their magnetic cards, and thereby forfeiting any accumulated winnings, are reduced.

In the preferred embodiment, it may also be desirable for additional information to be supplied to the central computer. Consequently, each player can be supplied with an enrollment form where the player can provide additional information such as name, address, etc., that can then be delivered to the location of the central computer. The information contained on the additional information card can then be input into a file corresponding to the player in the central computer. This additional information can be used for mailing purposes and can also be downloaded to the game, for example, when the player enrolls, so that the player receives a personal prompt.

Hence, the players' club network of the present invention does not require that there be a person who redeems the players' club awards and enrolls new players located on the premises of the gaming establishment. This permits the gaming system of the present invention to have games located in smaller gaming establishments that cannot otherwise afford an enrollment or redemption person. Moreover, the gaming system of the preferred embodiment does not require players to carry magnetic cards, which further enhances the flexibility of the gaming system. These and other objects and advantages of the present invention will become more fully apparent from the following description taken in conjunction with the accompanying drawings.

DETAILED DESCRIPTION OF THE PREFERRED EMBODIMENT

Figure 1:
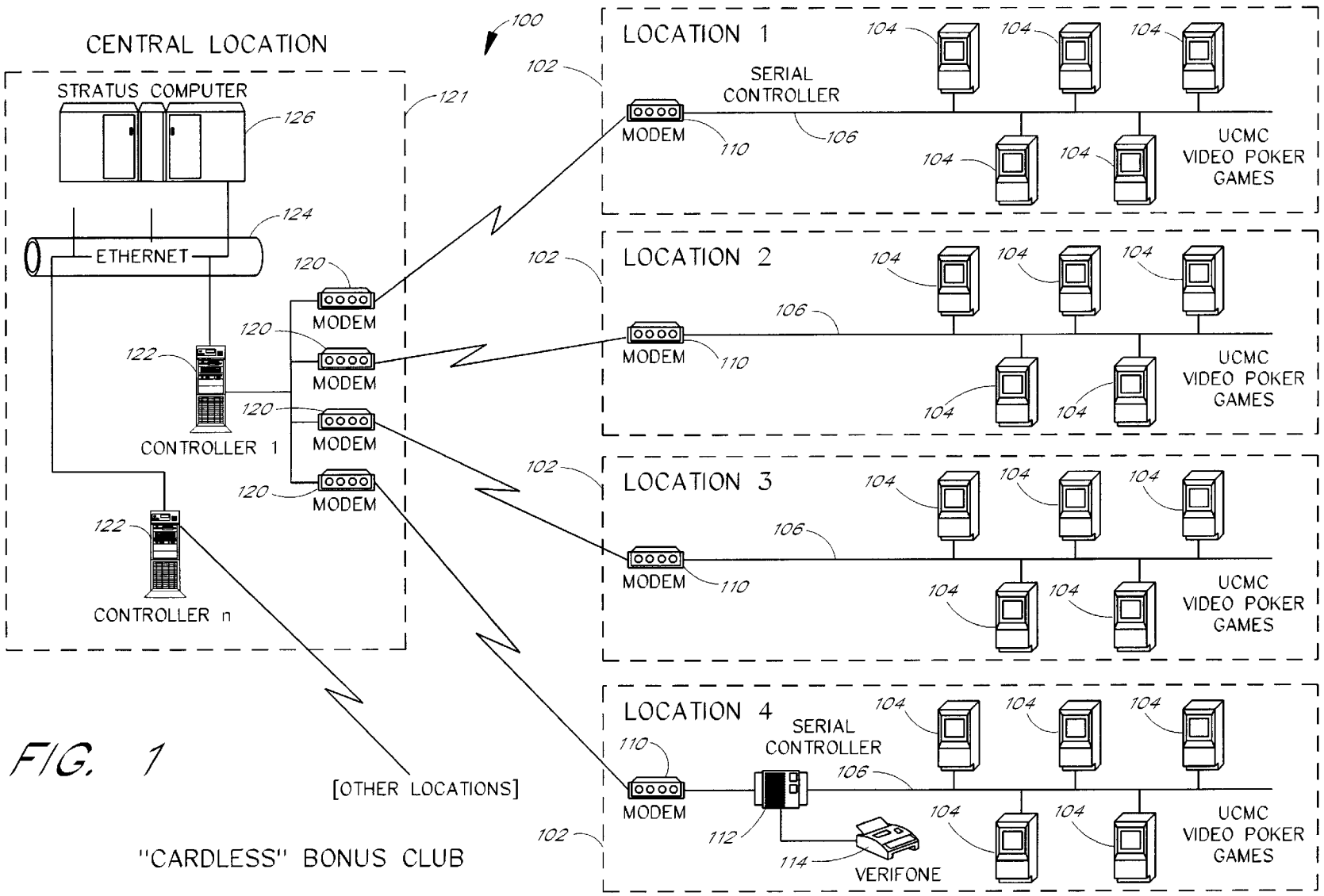
FIG. 1 is a top-level schematic diagram illustrating components of the cardless bonus club system of the preferred embodiment.

Reference will now be made to the drawings wherein like numerals refer to like parts throughout. FIG. 1 is a schematic diagram which illustrates the basic configuration of the cardless bonus club system 100 of the preferred embodiment. As shown in FIG. 1, the cardless bonus club system 100 includes a plurality of gaming machines 104 located at a plurality of different locations 102. Specifically, the locations 102 are geographically distinct locations such as casinos, bars and other business establishments that would have gaming devices. The gaming devices 104 are preferably linked together in a network within each of the locations and are connected to a modem 110. The modem 110 communicates with each of the gaming devices 104 and provides information via a phone line to a modem 120 in a central location 121. The modems 120 are each connected to a controller 122 which accumulates information and communicates via an ethernet-type connection 124 to a central computer 126.

As will be described hereinbelow, the gaming machines 104 are equipped with circuitry which allows them to provide information to the central computer 126 and receive information from the central computer 126. Hence, the cardless bonus club system 100 of the preferred embodiment comprises a wide area network with two-way communication between each of the gaming machines and a central computer. This allows for the central computer 126 to keep track of the performance of individual players as they play the gaming machines 104 in the network 100.

Figure 2:
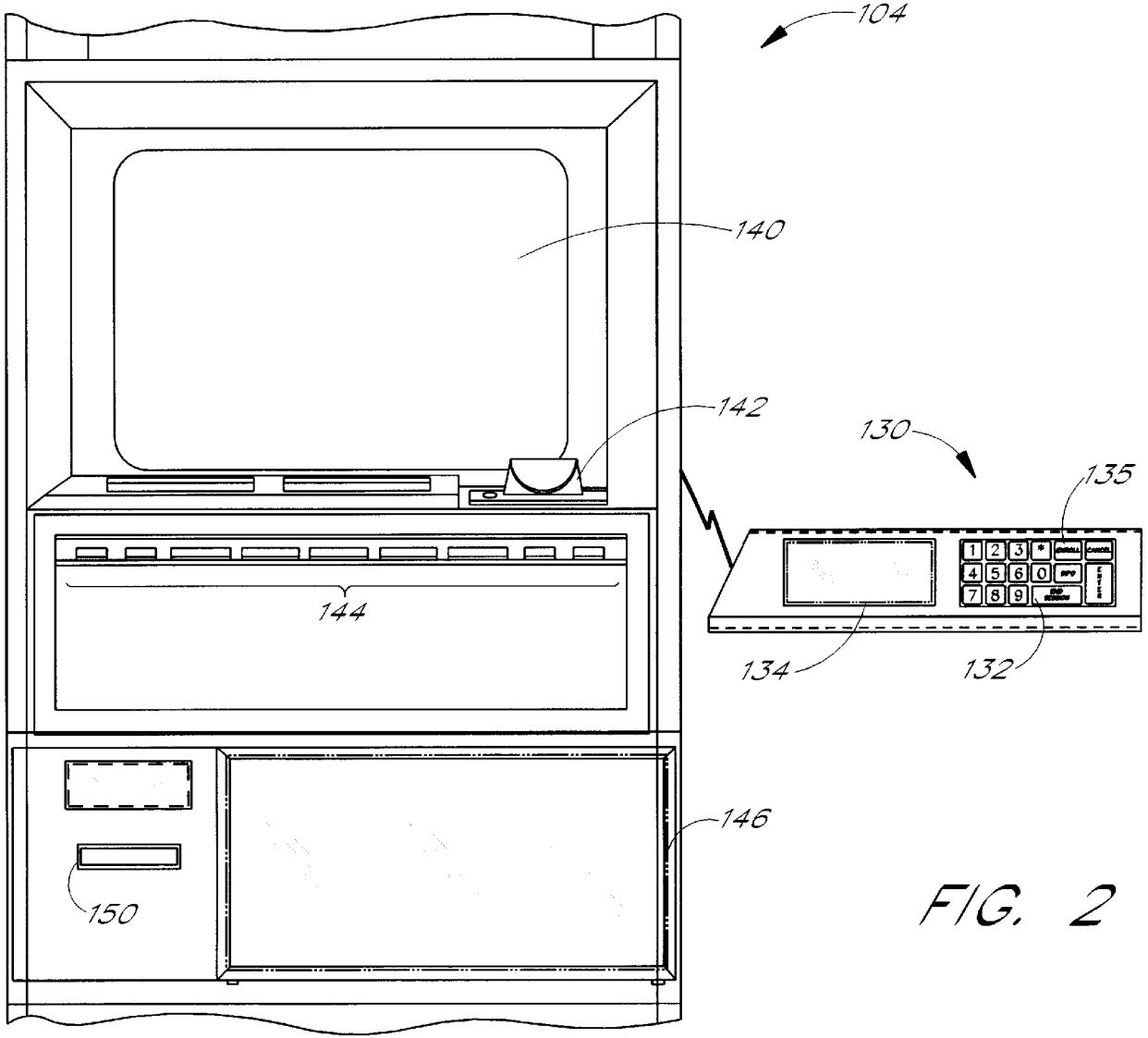
FIG. 2 is a front elevation view of a typical gaming machine with an associated communication device that forms a part of the cardless bonus club system of FIG. 1.

In the preferred embodiment, the gaming machines 104 are comprised of a United Coin and Machine Corporation, Model 906111 Video Poker Game, available from United Coin and Machine Company of Las Vegas, Nev. The gaming machines 104 have been modified to incorporate a communication device 130 (FIG. 2).

The communication device 130 permits players to send information to the central computer 126 and receive information from the central computer 126. Further, the gaming machines 104 have been modified so that they periodically can send information to the central computer 126 about the performance of the player during a play session in the manner that is described in more detail hereinbelow.

The gaming machines 104 in each of the locations are preferably linked together in a daisy-chain polling network 106 using a RS-485 protocol. The network 106 is then connected to the modem 110 which in the preferred embodiment is comprised of a Motorola V3225 modem that operates at 9600 baud. The modem 110 communicates with the modem 120 which in the preferred embodiment is also a Motorola V3225 9600 baud modem, via a phone link using an RS-232 protocol.

As shown in FIG. 1, there is a controller 122 associated with each of the locations in which the cardless bonus club system 100 is installed. In the preferred embodiment, the system can be installed in up to eight locations. However, it will be appreciated that the system 100 can be installed in more than eight locations and, in the preferred embodiment, there is one controller 122 for each eight locations. Further, the controller 122 in the preferred embodiment is comprised of a personal computer that is configured to accumulate data from the modems 120 and then periodically transmit the data via the ethernet 124 to the central computer 126. Further, the controller 122 also periodically receives information from the central computer 126 via the ethernet 124. Basically, the controller 122 is configured to control data traffic going to and coming from the central computer 126.

In the preferred embodiment, the central computer 126 is comprised of a Model 130 transaction computer from Stratus Inc. of Marlboro, Mass., and is capable of performing multiple transactions simultaneously. For example, the central computer 126 is capable of simultaneously recording and updating records for multiple players currently playing the gaming machines 104 attached to the system 100. The organization and operation of the central computer 126 will be described in greater detail in reference to FIGS. 3–5 hereinbelow.

Preferably, the gaming machines 104 in each location 102 are capable of dispensing awards to the players when the players receive winning combinations in a single round of playing the game. Further, as will be discussed in greater detail in reference to FIG. 5 below, the gaming machines 104 are also capable of dispensing bonus awards given by the system 100. Consequently, the gaming machines 104 typically include a coin dispensing mechanism.

However, in some locations it may either be impractical or illegal to use gaming machines with integral coin dispensing mechanisms. For example, a business establishment having the gaming machines 104 may be unable to pay larger winning awards. Consequently, these locations may also include a ticket printing device 114 which receives signals via a serial controller 112 from the gaming machines 104 indicating which of the gaming machines has won an award. The ticket printing device 114 then prints a ticket which is redeemable for the award received by the player. This type of setup for a particular location is illustrated in location 4 in FIG. 1.

FIG. 2 illustrates a typical gaming machine 104 used in the system 100 of the preferred embodiment. Specifically, the gaming machine 104 includes a video display 140, a coin accepting means 142 and a plurality of user inputs 144. In the preferred embodiment, the gaming machine 104 is a video poker game which displays representations of cards to the player on the video display 140. The player then manipulates the player inputs 144 to select and discard the cards displayed on the video display 140 and the gaming machine 104 then determines if the final set of cards displayed on the video display 140 corresponds to a winning combination. In the event that the gaming machine 104 determines that the player has achieved a winning combination, the gaming machine 104 then dispenses an appropriate award according to an awards table to the player. Generally, the award can either be dispensed as coins into a coin hopper 146 or can be added to a credit meter for the player. Hence, the gaming machine 104 of the preferred embodiment operates in the same manner as the well-known video poker games of the prior art.

However, the gaming machine 104 also includes a communication device 130 which includes a keypad 132, a display 134, and a processor, such as an Intel 8051 series processor, to perform the functions described hereinbelow. In the preferred embodiment, the communication device 130 enables the player to log into the cardless bonus club system by inputting an account number and a personal identification number using the keypad 132. Further, the communication device 130 also displays to the player his status in the bonus club game via the display 134.

In the preferred embodiment, the bonus club game is comprised of the game described in U.S. patent application Ser. No. 08/515,833 filed Aug. 16, 1995 now U.S. Pat. No. 5,639,088 entitled "MULTIPLE EVENTS AWARD SYSTEM" which is hereby incorporated by reference in its entirety. It will be appreciated, however, that any number of games which provide awards to players based upon play over time can be implemented in the cardless bonus club system 100 of the preferred embodiment. For example, a bonus club game wherein the player is awarded bonus points based upon the number of rounds played by the player can also be implemented using the bonus club system 100 of the preferred embodiment without departing from the spirit of the present invention.

Figure 3:
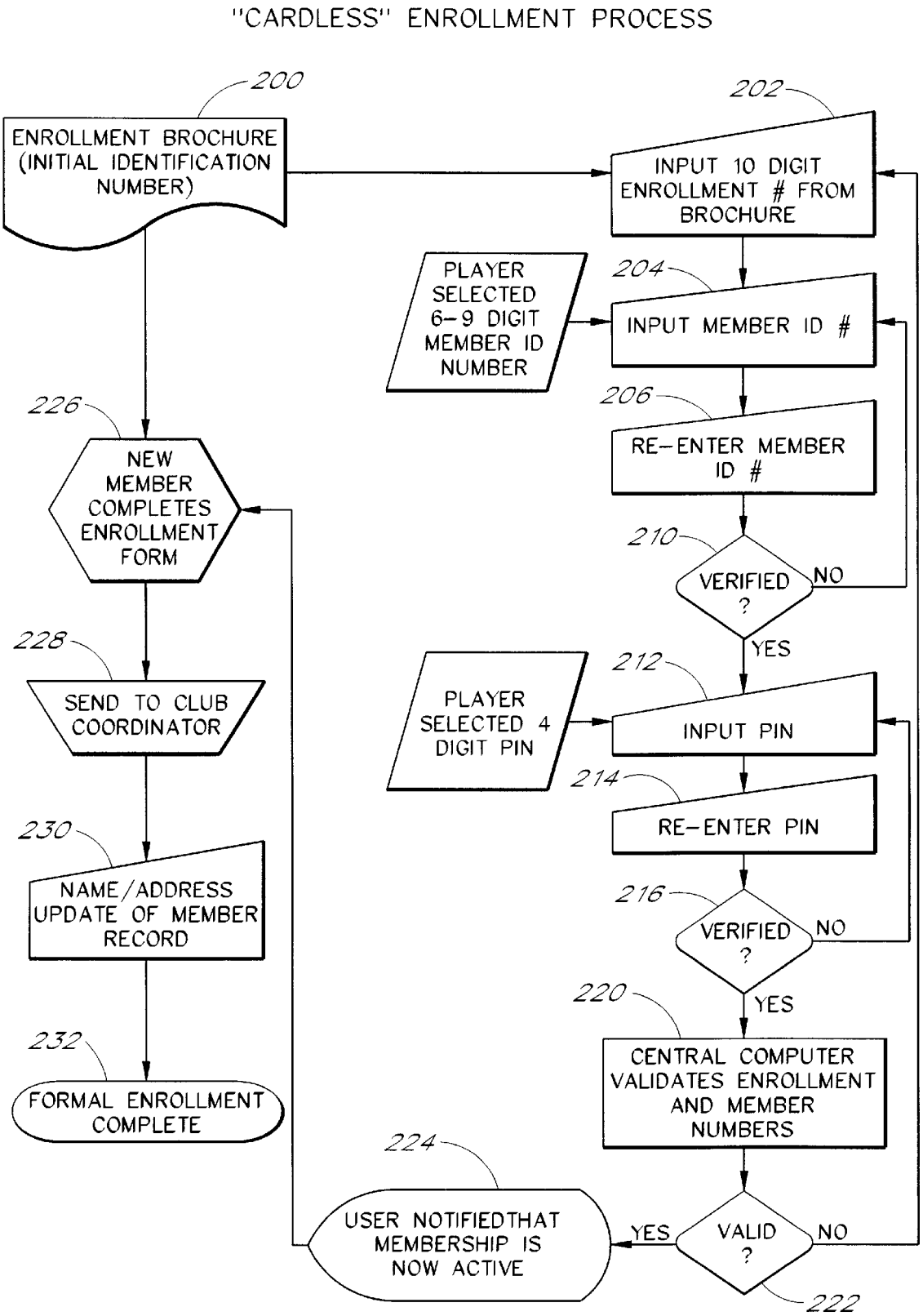
FIG. 3 is an exemplary flow chart illustrating an enrollment process in the cardless bonus club system of the preferred embodiment.

FIG. 3 illustrates the process whereby new players enroll into the bonus club network system 100. The bonus club system 100 of the preferred embodiment allows new players to enroll in the bonus club directly at the gaming machine 104 by using the communication device 130. Specifically, a new player initially receives an enrollment brochure 200 that is kept on hand in the game location 102. The enrollment form 200 includes an initial identification number that is imprinted on the enrollment form. The new player then takes the enrollment brochure 200 to one of the gaming machines 104 and depresses the enroll button 135 (FIG. 2) on the keypad 132 of the communication device 130.

This initiates an enrollment procedure whereby the communication device 130 displays on the display 134 a prompt for the new player to input the 10-digit enrollment number from the brochure 200 in a state 202. The selected enrollment number is then transmitted to the central computer 126 via the network 106 and the modems 110 and 120. The central computer 126 verifies the initial identification number input by the new player and then sends a signal to the communication device 130 which causes the communication device 130 to prompt the user to select and enter a member identification (ID) number using the keypad 132.

The new player then selects a six to nine digit ID number and inputs this number in state 204 using the keypad 132 of the communication device 130. The new player, in state 206, then re-enters the member ID number that they had previously selected and entered in state 204. Once the new player has entered their personally selected member ID number twice, the system 100 verifies the number in decision state 210. In the preferred embodiment, the verification is performed by ensuring that the number entered in state 204 and the number entered in state 206 match and that the number is at least six digits and no more than nine digits long.

Once the member ID number has been verified, the communication device prompts the new player to select and input a personal identification number (PIN) in state 212. The new player selects a four digit personal identification number and enters this number using the keypad 132. The new player re-enters the personal identification number in state 214 in response to a suitable prompt from the communication device 130.

Once the new player has input the personal identification number in the states 212 and 214, the communication device 130 then verifies the personal identification number in decision state 216. Specifically, the communication device 130 ensures that the personal identification number entered in state 212 matches the personal identification number entered in state 214 and verifies that the personal identification number is four digits long. In the event that the communication device 130 determines that the personal identification number is not verified in decision state 216, the new player is then prompted to input a personal identification number again in state 212.

Once the personal identification number has been verified in state 216, the communication device 130, in state 220, sends both the member ID number entered in states 204 and 206, and the personal identification number entered in states 214 and 216 to the central computer 126 via the network 106 and the modems 110, 120. The central computer 126 then determines whether the member ID number and the personal identification number are valid in decision state 222. The central computer 126 preferably determines whether the enrollment number entered in state 202 was a valid enrollment number and also checks to make sure that the personal identification number and the member ID number have not previously been entered by an already enrolled player. In the event that the central computer 126 determines that the member ID number or the personal identification number is not valid for any reason, the central computer 126 then returns the communication device to state 202 wherein the user is prompted to enter the 10-digit enrollment number from their brochure again.

In the event that the central computer 126 determines, in decision state 222, that the member identification number and the personal identification number are valid, the central computer 126 then establishes a file for the new player. The file will be described in greater detail hereinbelow in reference to FIG. 4. Further, the central computer 126 sends a signal in state 224 via the modems 110 and 120 to the gaming machine 104 notifying the new player that his or her membership is now active. The new player can then play rounds of the gaming machine 104 and his performance during these rounds will be recorded for bonus point purposes in the manner described in conjunction with FIG. 5 hereinbelow.

It will be appreciated, however, that it is generally desirable to have additional information about each of the players that are in the gaming system 100. Specifically, the player's name and address can be used for marketing purposes and also for such things as prompts on the display 134 of the communication unit 130. Consequently, in the preferred embodiment, the enrollment number is on an enrollment brochure form that is kept at the gaming location. The enrollment form also includes places for the new player to write, in state 226, his full name, any nickname, his telephone number, his mailing address, his date of birth, and his mother's maiden name for identification purposes. This card is then returned, in state 228, to the central location 121, e.g., to the coordinator of the players' club, wherein the information about the new player is then entered in state 230 into the central computer 126 using a terminal (not shown) in a well-known manner. This completes the formal enrollment process into the system of the preferred embodiment. This enrollment process enables new players to enroll directly at the machine thereby avoiding the need for an enrollment person to be positioned within the gaming location. Further, the new player is allowed to select an account number and a personal identification number. This eliminates the need for the player to receive a magnetic card and thereby reduces the difficulties associated with these cards.

Figure 4:
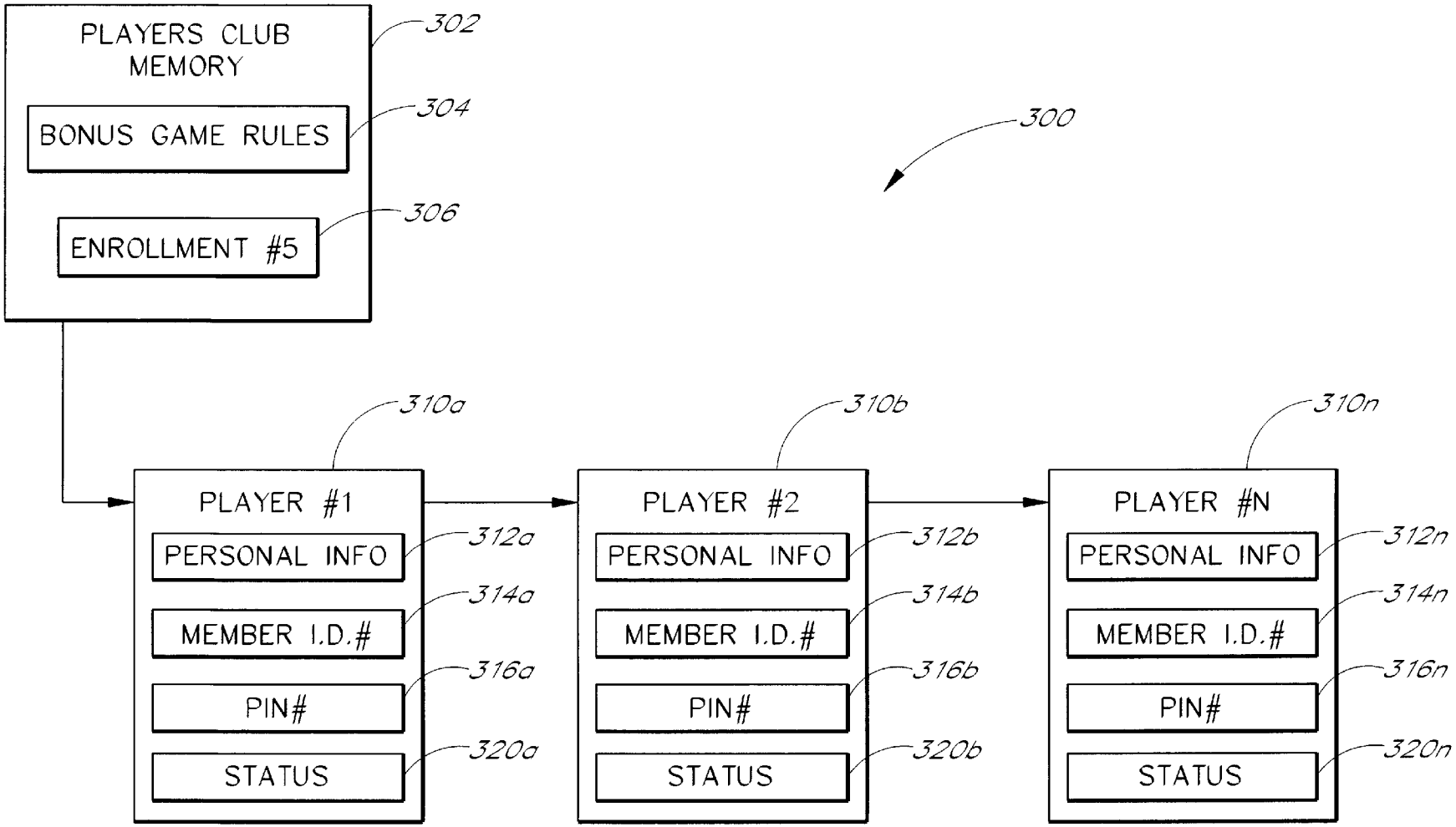
FIG. 4 is a block diagram illustrating an exemplary organization of a memory within a central computer of the cardless players' club system of FIG. 1.

FIG. 4 provides a basic diagram of the organization of the memory of the central computer 126. Specifically, the central computer 126 includes a memory 300 that is organized to include a players' club memory or data structure 302 wherein the rules of the bonus game are contained within a file 304. Further, each of the enrollment numbers printed on the enrollment forms are also stored in a data structure 306 so that when a new player initiates the enrollment process described in conjunction with FIG. 3, the enrollment number entered in state 202 can then be verified as being associated with the file generated for the enrolling player.

The memory 300 of the central computer 126 also includes files that are created as each additional new player completes the enrollment process described in conjunction with FIG. 3. Specifically, the enrollment process described in FIG. 3 results in a data structure 310 being created by the central computer 126 for each new player. The data structure 310 includes a member ID number line 314 which has the member identification number that was entered by the new player in state 204 (FIG. 3) and a personal identification number line 316 which has the personal identification number entered by the new player in state 212 (FIG. 3). Further, the data structure 310 for the player also includes a file 312 which has the personal information that was provided to the central computer 126 as a result of the player submitting the enrollment form with their name, address, etc.

Finally, each of the data structures 310 also includes a status line 320*a* which is indicative of the status of the player as they play the bonus club game. The information contained on the status line 320 is dependent upon the particular bonus game being implemented by the system 100. Specifically, if the bonus game is the bingo-type bonus game described in conjunction with U.S. Pat. No. 5,639,088, the status line 320 includes the winning combinations received by the player and the total number of rounds played by the player. Alternatively, if the bonus game awards bonus points to the player in proportion to the number of rounds played by the player, the status line 320 has information indicative of the number of rounds played by the player. As shown in FIG. 4, there is a similar data structure 310 created for all of the players (1-N) that have enrolled in the bonus game system 100. It will be appreciated that the exact configuration of the memory 300 is dependent upon a number of programming considerations and that the diagram shown in FIG. 4 is simply illustrative of one way of organizing the memory 300 of the computer 126.

Figure 5:
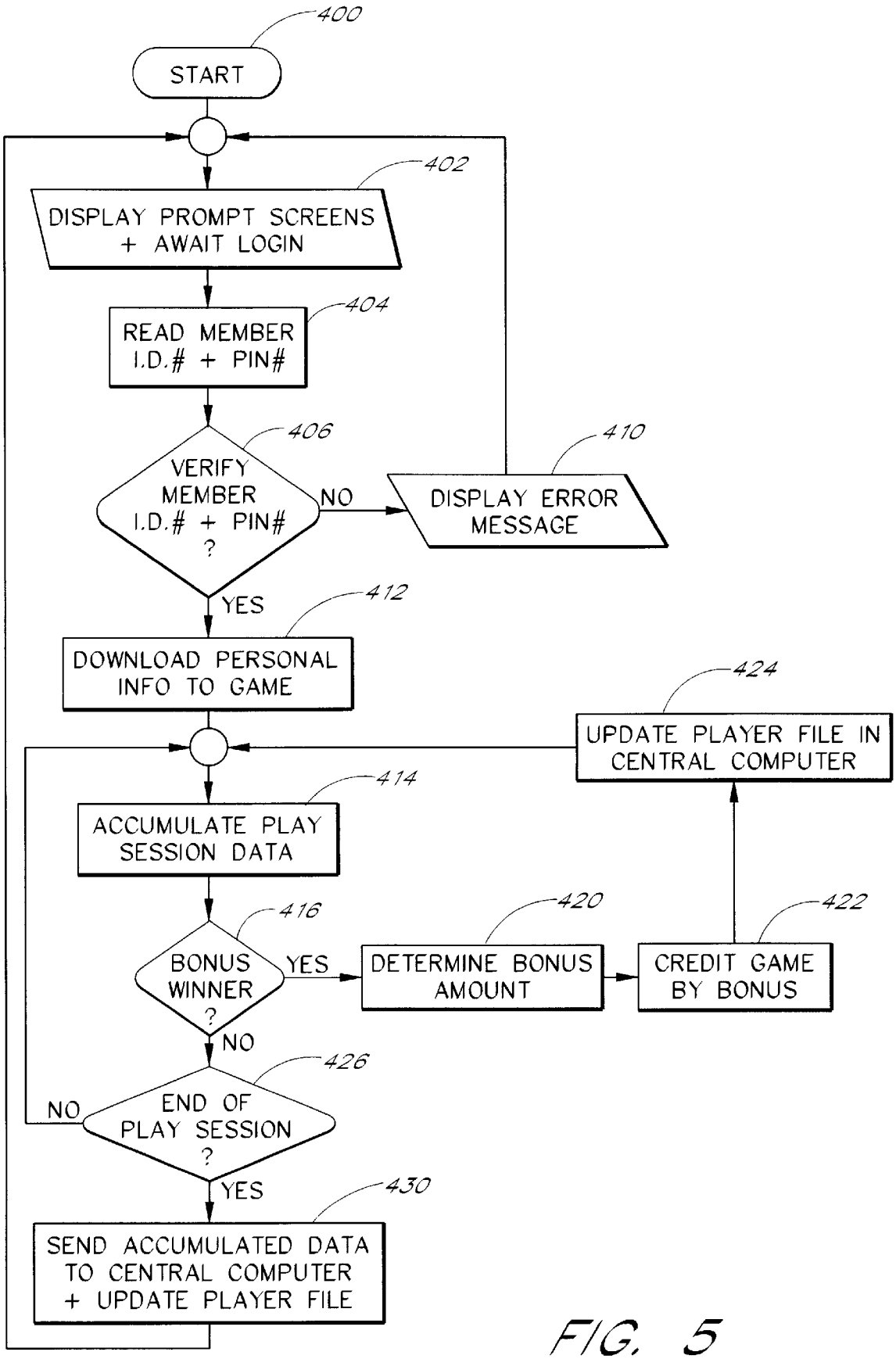
FIG. 5 is an exemplary flow chart illustrating the operation of the system in FIG. 1 during the course of a play session conducted by an individual player.

The operation of the gaming system 100 will now be described in reference to FIG. 5. FIG. 5 is an exemplary flow chart illustrating the operation of the system 100 while an enrolled player is playing a gaming machine 104 that is in the bonus club system 100. As described above, the gaming machine 104 of the preferred embodiment is a standard video poker machine wherein the player receives awards for a preselected group of winning combinations in a well-known manner. Further, the bonus club system 100 provides additional awards to the players as a result of the players' performance in multiple rounds of the game.

From a start state 400, the system displays prompt screens in state 402 on the displays of both the gaming machine 104 and the communication device 130. In the preferred embodiment, each of the gaming machines 104 in the system 100 are configured so that players who are enrolled in the players' club and also players who are not enrolled in the players' club can play the video gaming machine 104. The players who are not members of the players' club simply receive awards from the game directly based upon their performance in individual rounds of the game. Hence, the gaming machine 104 displays a standard prompt to encourage players to play the particular gaming machine. Further, the display 134 of the communication device 130 displays a prompt which prompts members of the players' club to enter their member ID number and their personal identification number using the keypad 132 (FIG. 2).

Once the player has entered their member identification number and their personal identification number, the communication device 130 reads the member identification number and the personal identification number in state 404. These numbers are then transmitted to the central computer 126 via the modems 110 and 120 (FIG. 1). The central computer 126 verifies, in decision state 406, whether the member identification number and the personal identification number correspond to the member identification number and personal identification number in a data structure 310 (FIG. 4) corresponding to an enrolled player.

In the event that the central computer 126 is unable to verify the member identification number and the personal identification number, the central computer 126 sends a signal to the communication device 130 which displays, in state 410, an error message to the player advising the player that he was unable to successfully log in to the bonus club system 100. The communication device 130 then returns to the display prompt state 402 described above. In the event that the central computer 126 is able to verify the member identification number and PIN number in decision state 406, the central computer 126 then downloads information to the communication device 130 in state 412. Specifically, the information that is downloaded from the central computer includes the player's name, which can then be displayed on the display 134, and the player's status in the bonus game.

The downloaded information varies depending upon the bonus game that is being implemented. For example, it can include the numbers of rounds, player or the winning combinations of a preselected set received or any other information specific to the bonus game being played by the player and their standing in the bonus game. This information is accessed through the data structure 310 via the status line 320 for the particular player.

Once the information has been downloaded, the system 100 and, in particular, the communication device 130, enters a state 414 wherein it accumulates play data from the gaming machine 104 as the player proceeds with playing rounds of the gaming machine during this particular play session. Specifically, the gaming machine 104 is configured to provide an indication to the communication device 130 indicative of the player's performance during a round of the game. Hence, the information in the communication device 130 relating to the player's performance is then updated to reflect the player's overall performance including the player's performance during the current play session.

The communication device 130 periodically determines, in decision state 416, whether the player has achieved a bonus award. Specifically, the player's performance information is preferably updated at the end of each round of the game and then compared with the downloaded game rules. In the event that the player's performance information indicates that the player is entitled to a bonus award, e.g., has played a sufficient number of rounds to justify bonus points or has achieved a preselected set of winning combinations, the communications device processor then, in state 420, determines the bonus award amount that is to be received by the player. After this amount is verified with the central computer 126, the processor in the communication device 130 then credits the game by the bonus amount in state 422.

Hence, the player receives any bonus award directly on the gaming machine 104 that the player is playing. Consequently, the need for the player to seek redemption for a bonus award from a redemption facility can be eliminated in the system 100 of the preferred embodiment. Generally, in the preferred embodiment, the bonus award is either provided to the player in the form of credits on the machine or, if the amount is large enough, the gaming machine 104 provides a signal to the player that he has received a large award and the central computer 126 provides a signal to the support staff of the central location 121 that the player has won a large award. The large award can then be delivered to the player either in person or via the mail or some other medium. It will be appreciated that any number of methods of providing the award to the player can be implemented without departing from the spirit of the present invention.

Subsequently, in state 424, the status line 320 of the player's data structure 310 (FIG. 4) is then updated to reflect that the player has now won the bonus award. In the embodiment where the player is attempting to obtain a set of winning combinations within a preselected number of rounds, the system 100 resets to the beginning wherein the player is now attempting to obtain the complete set of winning combinations within an initially selected number of rounds. The communication device processor 130 then returns to state 414 wherein the processor continues to accumulate data from the gaming machine 104 indicative of the player's performance in this play session.

In the event that the communication device processor 130 determines in state 416 that the player is not yet entitled to a bonus award, the processor then determines, in decision state 426, whether the player has ended his session of the game. In the preferred embodiment, the player ends a session of the game by depressing an "END SESSION" button 136 (FIG. 2) on the keypad 132 of the communication device 130. Alternatively, the system may assume that the player has ended the play session when it fails to receive any indication of activity on the gaming machine 104 within a preselected period of time. In the event that the end of the play session has not occurred, the processor returns to the state 414 wherein it continues to accumulate data about the performance of the player during this particular play session while the player is playing the gaming machine 104. However, in the event that the player has ended the play session, the communication device 130 then sends the accumulated data to the central computer 126 via the modems 110 and 120. This data is used by the central computer 126 to update the status line 320 of the data structure 310 corresponding to this particular player. Subsequently, the system 100 returns to state 402 wherein the prompt displays are displayed for the next player.

Hence, the bonus club gaming system 100 of the preferred embodiment provides a system wherein players can enroll in the system at the game and receive bonus awards directly on the game. This eliminates the need for a redemption facility or a redemption person in the location containing the games within the bonus club system. This allows the bonus club gaming system 100 of the preferred embodiment to be positioned in smaller business establishments that could not otherwise justify such a redemption facility or person. Further, the system 100 of the preferred embodiment allows the player to select a member identification number and then a personal identification number directly at the game while enrolling. This eliminates the need for the player to carry a card which would identify him or herself to the system and thereby eliminates the difficulties associated with lost cards.

Although the foregoing description of the preferred embodiment of the present invention has shown, described and pointed out the fundamental novel features of the invention, it will be understood that various omissions, substitutions and changes in the form of the detail of the apparatus as illustrated, as well as the uses thereof, may be made by those skilled in the art without departing from the spirit of the present invention. Consequently, the scope of the invention should not be limited to the foregoing discussion, but should be defined by the appended claims.

What is claimed is:

1. A distributed gaming system comprising:

a plurality of gaming machines, wherein said plurality of gaming machines are networked together and are distributed in a plurality of locations;

a central computer receiving signals from said plurality of gaming machines, wherein said central computer includes one or more records corresponding to players who have enrolled in said distributed gaming system and can play a selected game of the distributed gaming system; and a plurality of input devices coupled to said plurality of gaming machines so that said plurality of input devices are distributed in said plurality of locations, wherein said plurality of input devices provide signals to said central computer and wherein at least one of said plurality of input devices receives input from a user, comprising an identification code and an enrollment signal, and transmits said identification code to said central computer to enable said user to enroll in said distributed gaming system and wherein said central computer in response to receiving said identification code and said enrollment signal, creates a record for the user enabling the user to play said selected game of said distributed gaming system.

2. The system of claim 1, wherein each of said plurality of gaming machines has one of said plurality of input devices coupled thereto.

3. The system of claim 1, wherein each of said plurality of gaming machines provides signals to said central computer representative of the performance of a player enrolled in said gaming system while said player is playing said gaming machine and wherein said central computer keeps a record of the performance of said player over time.

4. The system of claim 3, wherein said gaming system provides awards to said player in response to the play of said player and wherein said gaming system provides a bonus award to said player based upon the performance of said player over time.

5. The system of claim 4, wherein said gaming system induces said gaming machine to provide said bonus award to said player while said player is playing said gaming machine.

6. The system of claim 5, wherein said gaming machine is comprised of a video gaming machine which has a credit meter that records the game credits that said player has received and wherein said bonus award is comprised of increasing the value of said game credits recorded in said credit meter by a selected bonus amount.

7. The system of claim 6, wherein said bonus award is comprised of a pre-determined number of credits on said credit meter that is awarded upon said player completing a pre-determined number of rounds of said game.

8. The system of claim 1, wherein said input device comprises a communication device that receives signals from said gaming machine indicative of the performance of a player during individual rounds of games played on said gaming machine.

9. The system of claim 8, wherein said communication device includes a keypad that, in response to manipulation by said player, provides signals to said central computer.

10. The system of claim 9, wherein a new player can enroll in said gaming system by a) entering a pre-defined enrollment identification number on said keypad, which results in said central computer designating a record corresponding to said new player, b) entering a personally selected account number on said keypad, and c) entering a personally selected personal identification number on said keypad which results in said central computer recording said personally selected account number and said personally selected personal identification number in said record corresponding to said new player.

11. The system of claim 10, wherein said central computer updates a performance record of said player in response to said player entering said player's account number and personal identification number and then playing one of said plurality of gaming machines.

12. A distributed gaming system comprising:

a plurality of gaming machines, wherein said plurality of gaming machines are networked and are distributed in a plurality of locations and wherein at least one of said plurality of gaming machines in each of said plurality of locations includes an input device having a keyboard which a player can manipulate to enter a pre-selected enrollment code using said keyboard to enable said new player to enroll in said distributed gaming system; and a central computer which receives signals from said plurality of gaming machines, wherein said central computer, in response to receiving a signal indicating that said new player is enrolling in said distributed gaming system, opens a record corresponding to said new player and wherein said central computer receives signals from one of said plurality of gaming machines indicative of the performance of said new player on said gaming machine and said central computer updates said performance record corresponding to said new player in response to the receipt of said signals indicative of performance, and wherein said central computer is configured to provide a signal to one of said gaming machines indicating that said new player is playing when said performance record of said new player indicates that said new player is entitled to receive a bonus award.

13. The system of claim 12, wherein said central computer includes a memory file containing a plurality of pre-selected enrollment codes and wherein said central computer verifies said enrollment code entered by said new player by comparing said enrollment code entered by said new player to said plurality of pre-selected enrollment codes in said memory file in order to identify a match.

14. The system of claim 13, wherein said new player uses said keyboard to enter an account number and a personal identification number which are then transmitted by said gaming machine to said central computer, thereby inducing said central computer to open a performance record corresponding to said player wherein said performance record includes information indicative of said account number, said personal identification number and the performance over time of said new player while playing said plurality of gaming machines.

15. The system of claim 14, wherein each of said gaming machines sends signals to said central computer representative of the performance of said new player during a play session in response to said new player entering said account number and said personal identification number prior to the beginning of said play session.

16. The system of claim 15, wherein each of said gaming machines includes a credit meter which provides an indication of the rounds of said gaming machine that said player can play and wherein each of said plurality of gaming machines are configured to increment the credits on said credit meter for said new player while said new player is playing said game in response to said central computer sending a signal indicative of said new player being entitled to said bonus award.

17. The system of claim 16, wherein said plurality of gaming machines is comprised of video poker gaming machines and wherein said video poker gaming machines provide credits to said credit meter in response to said player winning a round of play on said gaming machine wherein said credits correspond to monies won by said new player.

18. A method of playing a distributed gaming system having a plurality of gaming machines that are networked to a central computer, said method comprising the steps of:

enrolling a player in said distributed gaming system by player manipulation of a user input devices associated with one of said plurality of gaming machines to select a personal identification code comprising a plurality of characters selected by said user;

opening a record for said player in said central computer in response to the selection of said personal identification code;

entering said personal identification code on one of said plurality of gaming machines prior to beginning a play session;

verifying said personal identification code;

providing performance information to said central computer indicative of said player's performance in playing said gaming machine during said play session; and updating said player's record in said central computer to reflect said performance during said play session.

19. The method of claim 18, further comprising the steps of:

determining whether said performance information in said record indicates that a player is entitled to a bonus award; and providing a signal to said gaming machine during said play session to induce said gaming machine to provide said bonus award.

20. The method of claim 19, wherein said step of determining whether said performance information in said record indicates that said player is entitled to said bonus award comprises determining whether said performance information indicates that said player has played a pre-determined number of rounds.

21. The method of claim 20, wherein said step of providing a signal to induce said gaming machine to provide said bonus award comprises providing a signal to induce said gaming machine to add credits to a credit meter associated with said gaming machine.

22. The method of claim 18, wherein said step of enrolling in said distributed gaming system comprises the steps of:

entering an enrollment code on a keypad attached to one of said gaming machines;

entering a player selected account number on said keypad attached to said gaming machine; and entering a player selected personal identification number (PIN) on said keypad.

23. The method of claim 22, wherein said step of entering said personal identification code prior to beginning a play session comprises entering said player account number and said PIN using said keypad attached to said gaming machine which results in said central computer performing said verifying step and performing said updating step only when said personal identification code is verified.

24. A distributed gaming system comprising:

a plurality of gaming machines wherein said plurality of gaming machines are networked and are distributed in a plurality of locations;

a central computer receiving signals from said plurality of gaming machines, wherein said central computer includes one or more records corresponding to a plurality of players who have enrolled in said distributed gaming system; and a plurality of input devices coupled to said plurality of gaming machines, wherein said plurality of input devices provide signals to said central computer and wherein said plurality of input devices are configured to allow a player to provide a signal to said central computer that said player has initiated a play session on a particular gaming machine and wherein performance information is provided to said central computer indicative of said performance of said player during said player session and wherein said central computer determines whether the performance of said player over time indicates that said player is entitled to a bonus award and, upon determining that said player is entitled to a bonus award, said central computer induces said particular gaming machine to provide said bonus award to said player wherein at least one of said plurality of input devices is also configured to allow a new player to enroll in said distributed gaming system by manipulating said input device to select a personal identification code that said player will subsequently enter when initiating a play session.

25. The system of claim 24, wherein said central computer opens a record corresponding to said player in response to said player manipulating said input device to select said personal identification code.

26. The system of claim 25, wherein said central computer opens said record in response to said player manipulating said input device to enter a pre-determined enrollment code and then manipulating said input device to enter a player selected account number and personal identification number as said personal identification code.

27. The system of claim 24, wherein said plurality of gaming machines comprises a plurality of video poker gaming machines that provide an award to a player in response to said player receiving one of a plurality of pre-defined winning combinations.

28. The system of claim 27, wherein said central computer induces said particular gaming machine to provide a bonus award in response to said player receiving a pre-defined set of winning combinations within a pre-defined number of rounds.

29. A method of playing a distributed gaming system having a central computer and a plurality of networked gaming machines located in a plurality of locations wherein said method is comprised of the steps of:

enrolling a player in said distributed gaming system by said player manipulating a user input device associated with one of said plurality of gaming machines to select a personal identification code comprised of a plurality of characters selected by said player;

opening a record in said central computer corresponding to said player;

said player subsequently entering said personal identification code using an input device associated with a particular gaming machine prior to beginning a play session on said particular gaming machine;

initiating a play session on said particular gaming machine;

providing performance information to said central computer about said player's performance during said play session;

updating a record in said central computer for said player corresponding to said personal identification code with performance information about said player during said play session;

determining whether said performance information in said record indicates that said player is entitled to a bonus award; and inducing said particular gaming machine to provide said bonus award to said player upon determining that said player is entitled to said bonus award.

30. The method of claim 29, wherein said step of enrolling in said distributed gaming system comprises the steps of:

entering an enrollment code on a keypad attached to one of said gaming machines;

entering a player selected account number on said keypad attached to said gaming machine; and entering a player selected personal identification number (PIN) on said keypad.

31. The method of claim 30, wherein said step of entering said personal identification code prior to beginning a play session comprises entering said player account number and said PIN using said keypad attached to said gaming machine.

32. The method of claim 29, wherein said step of determining whether said performance information in said record indicates that said player is entitled to said bonus award comprises determining whether said performance information indicates that said player has played a pre-determined number of rounds.

33. The method of claim 29, wherein said step of providing a signal to induce said gaming machine to provide said bonus award comprises providing a signal to induce said gaming machine to add credits to a credit meter associated with said gaming machine.

34. A method of playing a distributed gaming system having a central computer and a plurality of networked gaming machines located in a plurality of locations wherein said method comprises:

enrolling a player in said distributed gaming system by manipulating a first user input device associated with the distributed gaming system so as to select a personal identification code comprised of a plurality of characters that are selected by the player;

opening a record in said central computer corresponding to said player;

initiating a play session on a selected gaming machine of the plurality of networked gaming machines by said player entering their personal identification code on a second input device associated with the selected gaming machine;

providing performance information to said central computer about said player's performance during said play session on said selected gaming machine;

updating a record in said central computer for said player corresponding to said personal identification code with performance information about said player during said play session;

determining whether said performance information in said record indicates that said player is entitled to a bonus award; and inducing said particular gaming machine to provide said bonus award to said player upon determining that said player is entitled to said bonus award.

35. The method of claim 34, wherein the step of enrolling in said distributed gaming system is comprised of:

entering an enrollment code on a keypad attached to one of said plurality of gaming machines;

entering a player selected account number on said keypad attached to said gaming machine; and entering a player selected personal identification number (PIN) on said keypad.

36. The method of claim 35, wherein the act of entering said personal identification code to initiate a play session comprises entering said player account number and said PIN using a keyboard attached to said selected gaming machine.

37. The method of claim of claim 34, wherein the step of determining whether said performance information in said record indicates that said player is entitled to said bonus award comprises determining whether said performance information indicates that said player has played a pre-determined number of rounds.

38. The method of claim 37, wherein said step of providing a signal to induce said gaming machine to provide said bonus award comprises providing a signal to induce said gaming machine to add credits to a credit meter associated with said gaming machine.

* * * * *